US009514719B1

(12) United States Patent
Ward

(10) Patent No.: US 9,514,719 B1
(45) Date of Patent: Dec. 6, 2016

(54) PIVOT HINGE FOR A COLLAPSIBLE STRINGED MUSICAL INSTRUMENT

(71) Applicant: John R Ward, Costa Mesa, CA (US)

(72) Inventor: John R Ward, Costa Mesa, CA (US)

( * ) Notice: Subject to any disclaimer, the term of this patent is extended or adjusted under 35 U.S.C. 154(b) by 0 days.

(21) Appl. No.: 14/957,454

(22) Filed: Dec. 2, 2015

(51) Int. Cl.
*G10D 3/06* (2006.01)
*G10D 1/08* (2006.01)

(52) U.S. Cl.
CPC . *G10D 3/06* (2013.01); *G10D 1/08* (2013.01)

(58) Field of Classification Search
CPC ..... G10D 1/08; G10D 1/085; G10D 1/00; G10D 17/00; B27H 1/00; E05D 3/186
USPC ..... 84/267, 290, 293
See application file for complete search history.

(56) References Cited

U.S. PATENT DOCUMENTS

| | | | | |
|---|---|---|---|---|
| 4,073,211 | A | 2/1978 | Jorgensen | |
| 5,390,578 | A | 2/1995 | Raymer | |
| 2008/0141842 | A1 | 6/2008 | Leach | |
| 2009/0151537 | A1 * | 6/2009 | Leach | G10D 1/08 84/293 |

* cited by examiner

*Primary Examiner* — Kimberly Lockett

(57) ABSTRACT

This is an improved pivot hinge for a collapsible stringed musical instrument providing for easy collapse and assembly of the instrument, such as the neck to the body of the instrument, collapsing into a sturdy, compact, and portable package, without altering the basic industry standard shapes and acoustics, and without twisting, or crimping the instrument's strings.

1 Claim, 3 Drawing Sheets

PIVOT HINGE FOR A COLLAPSIBLE STRINGED MUSICAL INSTRUMENT

FIELD OF INVENTION

This invention relates to stringed musical instruments with a collapsible neck

BACKGROUND—PRIOR ART

The following is a tabulation of some prior art that presently appears relevant:

| U.S. Patents | | | |
|---|---|---|---|
| Pat. No. | Kind Code | Issue Date | Patentee |
| 5,390,578 | | Feb. 21, 1995 | Raymer |
| 4,073,211 | | Feb. 14, 1978 | Jorgensen |
| 2008/0141842 | A1 | Jul. 7, 2008 | Leach |

A conventional stringed musical instrument is normally an assembly of a neck and body in one piece. Many of the instruments are too large for convenient travel as hand luggage on airplanes, and must be checked with the airline and transported in the baggage hold of the airplane, subjecting the instruments to damage from rough handling and crushing. In order to allow carrying onboard as hand luggage, some of these instruments have a neck to body joint that allows folding and or separation of the two parts, thus reducing the length of the instrument to an acceptable size.

But, the instrument is relatively large and delicate, requiring care in handling while assembling and disassembling. Once the tension of the strings is released and the neck is folded, the neck with attached strings must be stored with the body of the instrument, if the strings remain attached to both. Care must be taken with the folded neck to keep from twisting or tangling the strings.

Therefore, it is advantageous to have a hinge that allows the neck to fold and then holds it and the body in the collapsed position for storage or packing, is sturdy, and that protects the strings from twisting or crimping.

It is better if this collapsed position keeps the parts together to reduce the size and volume of the instrument.

Several types of hinged necks have been proposed.

U.S. Pat. No. 5,390,578 to Raymer (1995) proposes a folding guitar with a hinged neck. The neck pivots on an axis similar to my invention, but does not simultaneously and positively translate the neck away from the body. This system seems suited to solid body guitars since it requires modifying the shape of the top of the body to provide clearance for the neck. Such modification would alter the shape of the guitar body and also limit the positioning of electric pickup elements. It is known that acoustic guitar body shape, as well as placement of pickups in electric guitars is critical to tonal characteristics.

U.S. Pat. No. 4,073,211 to Jorgensen (1978) proposes a hinge whereby the neck folds straight down under the body of the instrument. This requires modifications to the underside of the body of the instrument to provide room for neck stowage and as stated above would alter the tonal characteristics of the instrument.

U.S. Patent 2008/0141842-A1 (2008) to Leach proposes using something similar to SOS hinges to allow the neck to fold straight up over the body, and provide clearance for the strings. The thickness of the hinge end of the neck and neck heel extends above the body even further due to the clearance provided for the strings by the hinge, and thus makes the collapsed instrument large and subject to damage.

ADVANTAGES

Accordingly several advantages of one or more aspects my invention are a pivot hinge assembly that, after relaxing string tension, provides for:

(a) lateral rotation of the neck while at the same time raising the neck to clear the body of the instrument
(b) pivot hinge is passive when the instrument is in the assembled position and therefore does not adversely affect the musical tone and vibration characteristics of the instrument, and
(c) the pivot hinge can be made very sturdy in order to resist damage from normal use
(d) no modifications to standard instrument shapes are required, and
(e) the hinge maintains the relationship of the neck and body of the instrument such that the strings are not twisted or crimped Other advantages of one or more aspects will be apparent from a consideration of the drawings and ensuing description.

DRAWINGS—REFERENCE NUMERALS—ALL EMBODIMENTS SHOWN

1 Instrument Body
2 Instrument Neck
3 Pivot Hinge Axle
4 Pivot Hinge Receiver
5 Alignment Pin
6 Alignment Plate
7 Clamping Fastener
8 Neck Bolt

DRAWINGS—FIGS. $1^{ST}$ EMBODIMENT

DETAILED DESCRIPTION—$1^{ST}$ EMBODIMENT

Figure 1:
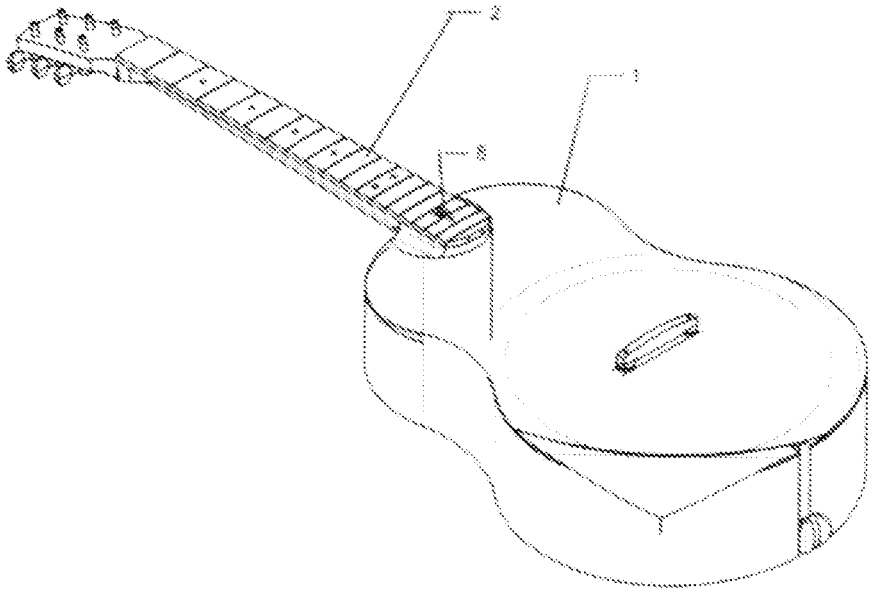
FIG. 1 is a view of the instrument in the assembled position

One embodiment of the pivot hinge is illustrated in FIG. 1 thru FIG. 6. An alignment plate 6 is bonded or fixed to an instrument body 1. A pivot hinge receiver 4 and an alignment pin 5 are slipped into a matching hole in the instrument body 1 and retained with a clamping fastener 7. A pivot hinge axle 3 is fixed to an instrument neck 2 with a neck bolt 8. The pivot hinge axle 3 is inserted into the pivot hinge receiver 4 and aligned with the alignment pin 5. The spiral groove in the pivot hinge axle 3 and the alignment pin 5 causes the pivot hinge axle 3 to translate when it is rotated causing the instrument neck 2 to translate toward the instrument body 1 when moved from the collapsed to the assembled position. When the instrument neck 2 is rotated very close to the assembled position, spiral groove in the pivot hinge axle 3 flattens out so that as the clamping fastener 7 is tightened it pulls the pivot hinge receiver 4 and the alignment pin 5 into the instrument body 1. The alignment pin impinges on the flattened spiral groove of the pivot hinge axle 3 thus bringing the matching grooves of the pivot hinge axle 3 and the alignment plate 6 forcing the instrument neck 2 and the instrument body 1 into alignment and clamped together tightly.

Operation

Strings are loosened using a mechanism not included in this application.

Figure 2:
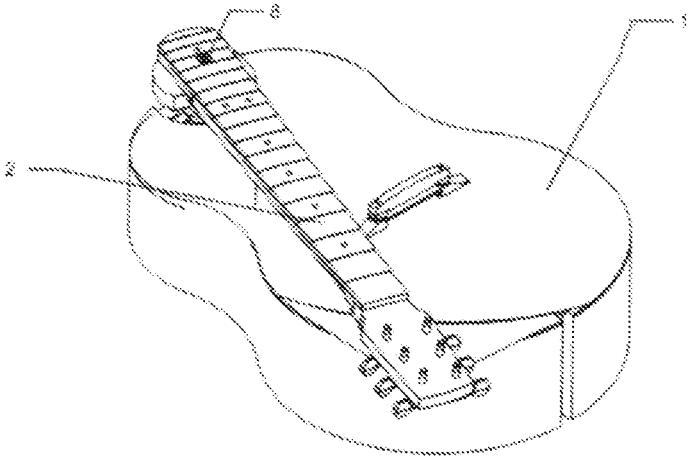
FIG. 2 is a view of the instrument in the collapsed or folded position
Figure 3:
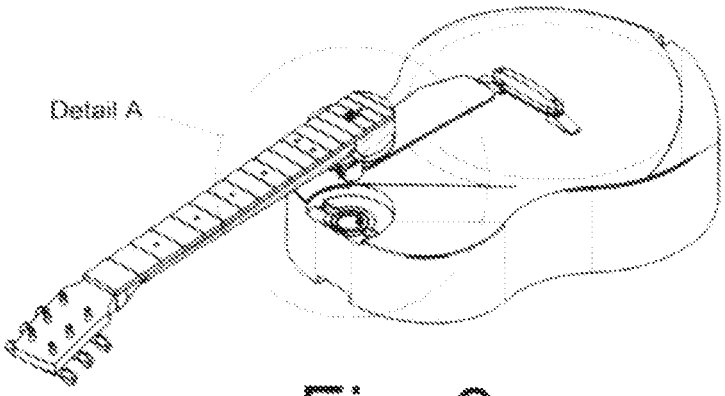
FIG. 3 is a partial exploded view of the instrument
Figure 4:
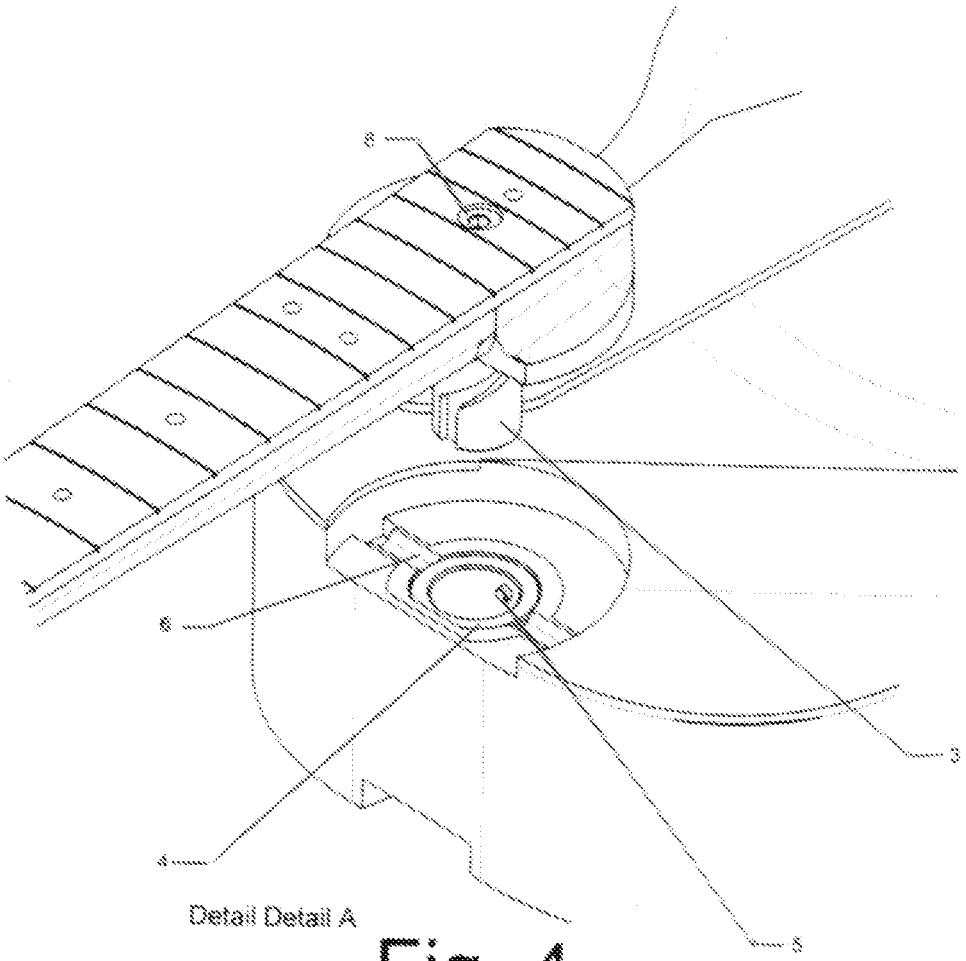
FIG. 4 is a detail view of FIG. 3
Figure 5:
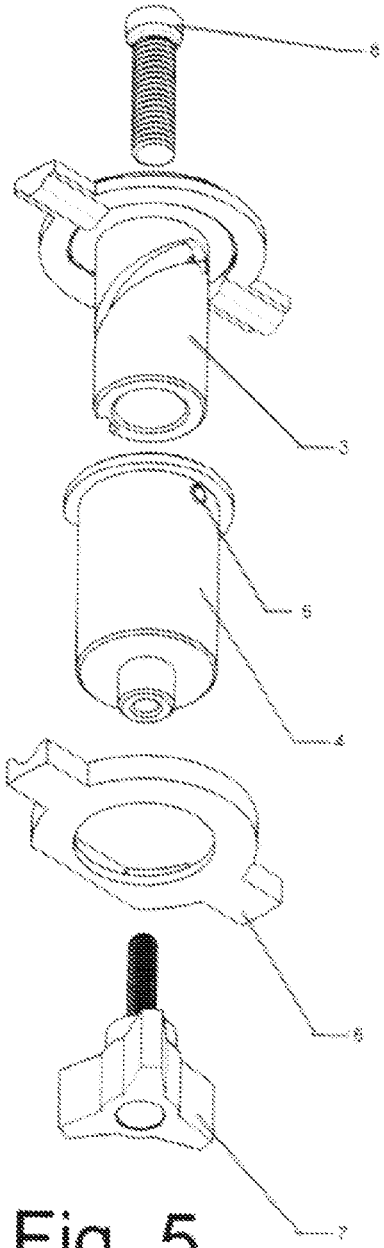
FIG. 5 is an exploded view of the pivot parts not showing the neck and body
Figure 6:
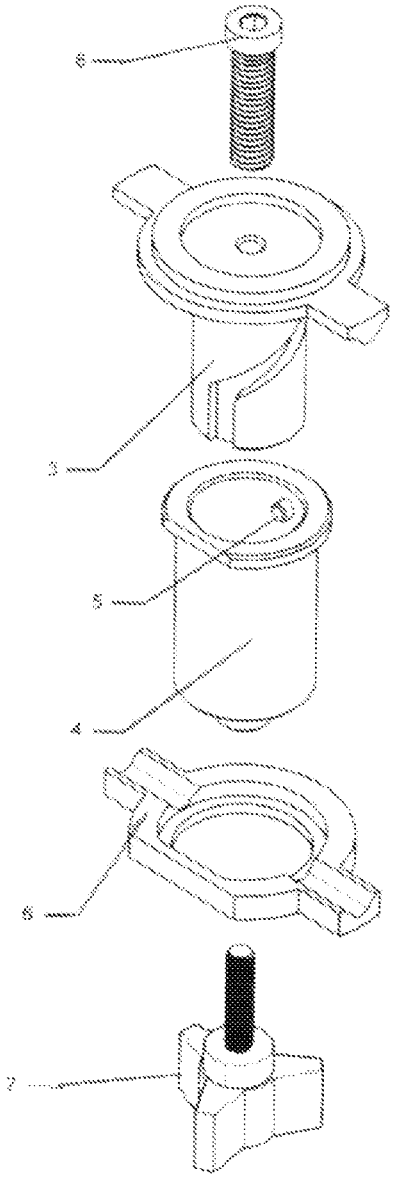
FIG. 6 is another exploded view of the pivot parts not showing the neck and body Note: Strings not shown for clarity

With the assembled instrument as in FIG. 1, loosen clamping fastener 7 and rotate neck 2 to the position shown in FIG. 2. As shown, this action causes the instrument neck 2 to translate along the axis of the pivot hinge receiver 4, elevating the instrument neck 2 and thus providing clearance between said instrument neck 2 and said instrument body 1. Reversing the above procedure assembles the instrument.

Advantages

From the description above, a number of advantages of some embodiments of my invention become evident:

(a) The pivot hinge provides an easy procedure for assembly or disassembly of the instrument (b) The hinge keeps the neck and body connected and nested to minimize the volume and size of the collapsed instrument (c) The pivot hinge can be made quite sturdy to resist damage in operation (d) Any stringed instrument with a neck can be reduced in size so as to make it more convenient for travel.

(e) The pivot hinge does not require large modifications to the normal construction and characteristics of an industry standard stringed instrument.

(f) The pivot hinge is passive when the instrument is in the assembled position and therefore does not adversely affect the musical tone and vibration characteristics of the instrument, and (g) the hinge maintains the relationship of the neck and body of the instrument such that the strings are not twisted or crimped

Conclusions, Ramifications, and Scope

Accordingly, the reader will see that at least one embodiment of my pivot hinge provides an easier to use collapsible stringed musical instrument. Also, my pivot hinge will not alter the basic industry standard shape for stringed musical instruments. My pivot hinge can be used on, but not limited to, solid body guitars, hollow body guitars, banjos, mandolins, violins, and ukuleles. My pivot hinge makes travel with a collapsible stringed musical instrument a more practical alternative than travel with non-collapsible stringed musical instruments.

While my pivot hinge has been described and defined by reference to the embodiment shown, such reference does not imply a limitation on the scope of the embodiments, and no such limitation is to be inferred. My pivot hinge is capable of considerable modification, alteration, and equivalents in form and function, as will occur to those ordinarily skilled and knowledgeable in the pertinent arts. The depicted and described embodiment of my pivot hinge is exemplary only, and is not exhaustive of the scope my invention. Consequently, the scope is intended to be limited only by the spirit and scope of the appended claims, giving full cognizance to equivalents in all respects.

I claim:

1. A collapsible stringed musical instrument comprised of a body and a neck, said body and said neck each having a common axis, and said neck having a cylindrical surface mounted concentric with said axis, and said body having cylindrical surface mounted concentric with said axis, and said cylindrical surfaces having complimentary diameters to allow said neck to pivot relative to said body and said cylindrical surfaces having complimentary threads, ramps, grooves, or pins to cause said neck to translate along said axis relative to said body when said neck is pivoted about said axis relative to said body, said rotation and said translation allowing said neck to pivot and translate into a collapsed position and to provide clearance for said neck to said body in the collapsed position.

* * * * *